US008494026B2

(12) United States Patent
Andersson

(10) Patent No.: US 8,494,026 B2
(45) Date of Patent: Jul. 23, 2013

(54) FASTENING MEANS FOR TERMINALS FOR ELECTRICAL RESISTANCE ELEMENTS

(75) Inventor: Jan Andersson, Västerås (SE)

(73) Assignee: Sandvik Intellectual Property AB, Sandviken (SE)

( * ) Notice: Subject to any disclaimer, the term of this patent is extended or adjusted under 35 U.S.C. 154(b) by 98 days.

(21) Appl. No.: 12/746,089

(22) PCT Filed: Nov. 26, 2008

(86) PCT No.: PCT/SE2008/051351

§ 371 (c)(1),
(2), (4) Date: Jul. 13, 2010

(87) PCT Pub. No.: WO2009/072964

PCT Pub. Date: Jun. 11, 2009

(65) Prior Publication Data

US 2010/0278208 A1 Nov. 4, 2010

(30) Foreign Application Priority Data

Dec. 5, 2007 (SE) ..... 0702701

(51) Int. Cl.
*H05B 3/66* (2006.01)

(52) U.S. Cl.
USPC ..... 373/128; 219/541

(58) Field of Classification Search
USPC ..... 373/128, 129, 114, 117, 118, 119, 373/125, 130, 131, 132, 82, 79, 81, 83, 71, 373/72, 80, 84, 85, 42, 43; 219/541, 542, 219/543, 505, 523, 552, 553, 544, 343, 201, 219/219, 222, 242; 174/77 R, 51, 73.1, 75 D, 174/84 R, 85
See application file for complete search history.

(56) References Cited

U.S. PATENT DOCUMENTS 1,421,588 A * 7/1922 Shirk et al. ..... 219/247

(Continued)

FOREIGN PATENT DOCUMENTS

EP 0331880 A1 * 9/1989

OTHER PUBLICATIONS

SIPO—Chinese Patent Application No. 200880119156.4—Office Action—Issued Jul. 2, 2012—Including English Translations of Notification of First Office Action and Text of the First Office Action.
SIPO—Chinese Patent Application No. 200880119156.4—Office Action—Issued Jan. 14, 2013—Including English Translations of Notification of Second Office Action and Text of the Second Office Action.

*Primary Examiner* — Henry Yuen
*Assistant Examiner* — Phuong Nguyen
(74) *Attorney, Agent, or Firm* — Morgan, Lewis & Bockius LLP

(57) ABSTRACT

A suspension arrangement for terminals for electrical resistive elements, which terminals pass vertically through a body and are attached relative to the upper surface of the body, which terminals pass over into the hot zone of the resistive element in the form of a shank element, which extends downwards from the terminals, where one or several of the shanks of the hot zone is or are supported by hooks attached to the lower surface of the body. The suspension arrangement for each one of the terminals includes a first attachment attached relative to the upper surface of the body and a second attachment attached relative to the terminal. A spring arrangement passes between the first and the second attachment, which spring arrangement is arranged such that the second attachment is mobile in the vertical direction relative to the first attachment.

3 Claims, 1 Drawing Sheet

U.S. PATENT DOCUMENTS 2,617,002 A * 11/1952 Hasley ..... 174/77 R
4,870,256 A 9/1989 Heise et al.
5,641,292 A * 6/1997 Fann ..... 439/103
6,689,992 B1 * 2/2004 Ramos et al. ..... 219/541

* cited by examiner

FASTENING MEANS FOR TERMINALS FOR ELECTRICAL RESISTANCE ELEMENTS

The present invention relates to a suspension arrangement for terminals for electrical resistive elements.

One type of electrical resistive elements is suspended vertically in a holder, in the form of a body, through which terminals pass. The element normally has several shanks, whereby the upper bend zones of the element are suspended in hot zone attachments in the form of hooks, which are attached to the holder. The terminals are furthermore attached at the upper surface of the holder in order in this way to bear the weight of the terminals. The element in its hot condition is unable to bear the weight of the terminals.

The hot zone, the hot zone attachments and the terminals all become longer when heated. The extension of the terminals between the respective holder of the terminals and the level of the upper part of the hot zone is greater than the extension of the hot zone attachments. This results in the weight of the terminals being transferred to the first hot zone shank, which results in a deformation of this shank taking place.

The reverse process takes place during cooling, i.e. the terminals shrink relatively more than the hot zone attachments. The shrinkage of the terminals leads to the complete element being lifted and resting on the two terminal holders. There is no reduction in load for the hot zone in this condition.

During a subsequent heating operation, the hot zone is heated more rapidly than the terminals, whereby imbalance between the suspension points is evened out through deformation of the hot zone.

It will not be possible to control this sequence of events during cyclic variation in temperature, whereby deformation of the element system will escalate, resulting in the destruction of elements.

The present invention solves this problem.

The present invention thus relates to a suspension arrangement for terminals for electrical resistive elements, which terminals pass vertically through a body and are attached relative to the upper surface of the body, which terminals pass over into the hot zone of the resistive element in the form of a shank element, which extends downwards from the terminals, where one or several of the shanks of the hot zone is or are supported by hooks attached to the lower surface of the body, and it is characterised in that the suspension arrangement for each one of the terminals comprises a first attachment attached relative to the upper surface of the body and a second attachment attached relative to the terminal, and in that a spring arrangement passes between the first and the second attachment, which spring arrangement is arranged such that the second attachment is mobile in the vertical direction relative to the first attachment.

Figure 2:
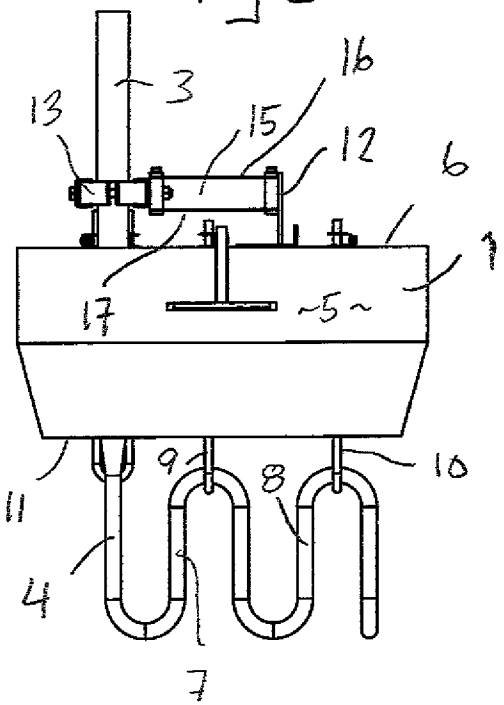
Figure 1:
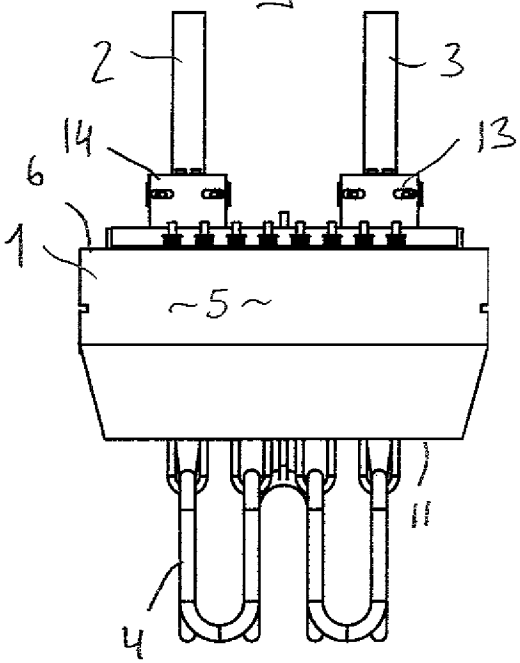

The invention is described in more detail below, partially in connection with an embodiment of the invention shown in the attached drawing, where FIG. 1 shows a suspension arrangement according to the invention seen in a view from the front, and FIG. 2 shows the suspension arrangement in FIG. 1 in a view from the side.

FIG. 1 shows a suspension arrangement 1 for terminals 2, 3 for electrical resistive elements 4. The terminals pass vertically through a body 5 and are attached relative to the upper surface 6 of the body 5. The terminals pass over into the hot zone of the resistive element 4 in the form of a shank element, which extends downwards from the terminals 2, 3. One or several of the shanks 7, 8 of the hot zone 4 is or are supported by hooks 9, 10 attached to the lower surface 11 of the body.

According to the invention, the suspension arrangement 1 comprises for each one of the terminals 2, 3 a first attachment 12 attached relative to the upper surface 6 of the body 5 and a second attachment 13, 14 attached relative to the terminals 2, 3 where a spring arrangement 15 passes between the first 12 attachment and the second 13, 14 attachment, which spring arrangement 15 is arranged such that the second attachment 13, 14 is mobile in the vertical direction relative to the first attachment 12.

The body with the terminals and the resistive element is arranged to be inserted into, for example, a hole in the roof of a furnace, such that the terminals protrude above the roof of the furnace and such that the hot zone of the resistive element is located in the furnace cavity.

According to one preferred embodiment, the spring arrangement 15 comprises a blade spring that is oriented essentially parallel with the upper surface 6 of the body 5.

According to a further preferred embodiment, the spring arrangement 15 comprises two blade springs 16, 17 that are arranged parallel to each other.

According to a highly significant embodiment, the spring arrangement 15 has an upwardly directed spring force that corresponds to at least the weight of the terminal 2, 3 and its electrical connections.

In this way, vertical movements in the terminals due to their extension and shrinking at different temperatures and due to movement of the hot zone will be allowed through the spring arrangement.

Thus, the problem described in the introduction will be avoided.

A number of embodiments have been described above. It is, however, obvious that the spring arrangement can be given another design without deviating from the innovative concept, which is that of suspending the terminals in a spring arrangement in order to allow vertical movement of the terminals.

The present invention, therefore, is not to be considered to be limited to the embodiments specified above but it can be varied within the scope specified by the attached patent claims.

The invention claimed is:

1. A suspension arrangement for terminals for electrical resistive elements, which terminals pass vertically through a body and are attached relative to the upper surface of the body, which terminals pass over into the hot zone of the resistive element in the form of a shank element which extends downwards from the terminals, wherein one or several of the shanks of the hot zone is or are supported by hooks attached to the lower surface of the body, the suspension arrangement for each one of the terminals comprising:

a first attachment attached relative to the upper surface of the body and a second attachment attached relative to the terminal, the first attachment spaced apart from the second attachment in a direction parallel with the upper surface of the body, wherein a spring arrangement passes between the first and the second attachment, the spring arrangement arranged such that the second attachment is mobile in the vertical direction relative to the first attachment, the spring arrangement being orientated essentially parallel with the upper surface of the body; and wherein the spring arrangement comprises a blade spring that is orientated essentially parallel with the upper surface of the body.

2. A suspension arrangement according to claim 1, wherein the spring arrangement comprises two blade springs that are arranged with each other.

3. The suspension arrangement according to claim 1, wherein the spring arrangement has an upwardly directed spring force that corresponds to at least the weight of the terminals and their electrical connections.

* * * * *